United States Patent [19]

Byrne

[11] Patent Number: 4,995,218

[45] Date of Patent: Feb. 26, 1991

[54] METHOD OF PACKAGING A BEVERAGE

[75] Inventor: William J. Byrne, Mount Merrion, Ireland

[73] Assignee: Arthur Guinness Son & Company (Dublin) Limited, Dublin, Ireland

[21] Appl. No.: 345,209

[22] Filed: Apr. 28, 1989

[30] Foreign Application Priority Data

Sep. 12, 1988 [GB] United Kingdom ..... 8821264

[51] Int. Cl.[5] ..... B65B 31/00; B65B 3/02; B65B 29/06; B65D 85/72

[52] U.S. Cl. ..... 53/410; 53/432; 53/467; 53/471; 426/115; 426/131; 426/397; 206/219; 220/1 BC

[58] Field of Search ..... 53/410, 423, 432, 433, 53/467, 470, 471, 474, 97, 510, 511; 426/112, 115, 118, 119, 131, 394, 395, 397; 215/1 C, 6, DIG. 8; 206/216, 219, 221; 220/1 BC

[56] References Cited

U.S. PATENT DOCUMENTS

| | | | |
|---|---|---|---|
| 55,341 | 6/1866 | Morse | 215/6 |
| 611,520 | 9/1898 | Smith | 206/211 |
| 3,145,838 | 8/1964 | van Deusen | 206/221 |
| 3,224,158 | 12/1965 | Baumann | 53/470 X |
| 3,282,708 | 11/1966 | Cushman | 426/112 X |
| 3,305,368 | 2/1967 | Bourelle | 206/219 X |
| 3,342,009 | 9/1967 | Anderson | 53/432 |
| 3,607,303 | 9/1971 | Bingham | 426/397 X |
| 3,733,771 | 5/1973 | Megowen | 53/471 |
| 4,060,956 | 12/1977 | Goble | 53/432 |
| 4,112,650 | 9/1978 | Tucker | 53/467 X |
| 4,588,000 | 5/1986 | Malin et al. | 53/432 X |
| 4,627,986 | 12/1986 | Bardsley et al. | 426/115 X |
| 4,693,054 | 9/1987 | Spargo | 53/432 |
| 4,703,609 | 11/1987 | Yoshida et al. | 53/474 X |
| 4,832,968 | 5/1989 | Forage et al. | 426/115 X |

FOREIGN PATENT DOCUMENTS

| | | | |
|---|---|---|---|
| 1266351 | 3/1972 | United Kingdom | 426/112 |
| 2182762 | 5/1987 | United Kingdom | 220/1 BC |

*Primary Examiner*—Horace M. Culver

[57] ABSTRACT

Method of packaging a beverage having gas in a solution in which an open topped container is charged with the beverage therethough. The container is purged of air and pressurized with gas selected from carbon dioxide, nitrogen or other inert gas and a partition having a restricted orifice is located over the beverage and sealed to the container to form a primary beverage chamber. A closure wall is located over the partition and sealed thereto and to the container to form with the partition a secondary chamber. The primary and secondary chambers communicate with each other through the restricted orifice. The assembly is inverted so that beverage from the primary chamber enters the secondary chamber and a primary headspace is formed in the primary chamber and a secondary headspace in the secondary chamber. Both headspaces are at a pressure greater than atmospheric so that upon opening the container exposing the primary chamber to atmosphere, beverage and/or gas in the secondary chamber is ejected into the beverage in the primary chamber to develop a head of froth.

Pressurization of the container with the selected gas is preferably by dosing with the gas in liquid form before the closure wall is fitted and sealed to the container and either before or after the partition has been fitted to the container.

14 Claims, 2 Drawing Sheets

METHOD OF PACKAGING A BEVERAGE

TECHNICAL FIELD & BACKGROUND ART

This invention relates to a method of packaging a beverage and particularly concerns beverages containing gas in solution and packaged in a sealed container which, when opened for dispensing or consumption of the beverage, permits gas to be evolved or liberated from the beverage to form, or assist in the formation of, a head or froth on the beverage. The beverages to which the invention relates may be alcoholic or non-alcoholic and will be packaged in a two chambered container so that when the container is opened, gas and/or beverage from one chamber is ejected into beverage in the other chamber to cause gas in solution in the beverage to evolve and form a head of froth. Advantages which are to be derived from such two chambered beverage packages and methods of packaging the beverage in the containers are discussed in our British Patent Specification No. 2,183,592A. A further example of a two chambered beverage package of the type referred to is disclosed in our British Patent Specification No. 1,266,351 (which is also referred to in the aforementioned G.B. No. 2,183,592A).

The method of packaging the beverage in a two chambered container as proposed in G.B. No. 1,266,351 was found to be unacceptable commercially in view of difficulties experienced in gas pressurising one of the chambers in the container and efficiently sealing the container following such pressurisation. On the contrary, however, the preferred method of packaging the beverage disclosed in G.B. No. 2,183,592A in which one of the two chambers is provided by a hollow pod which is inserted within the container has met with considerable commercial success. Nevertheless, this latter packaging method is inconvenient and relatively expensive in so far as a conventional beverage container/packaging line has to be modified considerably, especially to provide for the insertion of the pre-formed hollow pods into the container prior to the container being charged with its required volume of beverage. It is an object of the present invention to provide an efficient method of packaging a beverage in a two chambered container as broadly envisaged by the disclosure in G.B. No. 2,183,592A and which method alleviates the requirement for inserting a hollow pod into a preformed container as a means for forming one of the chambers.

STATEMENT OF INVENTION & ADVANTAGES

According to the present invention there is provided a method of packaging a beverage having gas in solution therewith which comprises providing an open topped container and charging the container with the beverage; locating a partition wall having a restricted orifice over the beverage in the container to form a primary chamber within which the beverage is contained and which primary chamber is sealed other than for said orifice; locating a closure wall over the partition wall to provide a sealed package in which the closure wall forms with the partition wall a secondary chamber which is sealed other than for the restricted orifice through which the secondary chamber communicates with the primary chamber, and which further comprises subjecting the container over the beverage to a gasifying medium prior to sealing the package so that a gas pressure greater than atmospheric is provided in the sealed package and inverting the sealed package so that the beverage enters the secondary chamber from the primary chamber through said restricted orifice to form a primary headspace in the primary chamber and a secondary headspace in the secondary chamber when the gas and beverage are at equilibrium.

Further according to the present invention there is provided a beverage package when formed by the method specified in the immediately preceding paragraph.

The beverage and gas (or gases) are preferably as discussed in our Specification G.B. No. 2,183,592A. The beverage may therefore typically be fermented such as beer, stout, ale, lager and cider, be a so-called soft drink such as fruit juice, squash, cola, lemonade, milk and milk based drinks or be a more alcoholic-type drink such as spirits, liquors, wine or wine based drinks. The gas is typically at least one of carbon dioxide gas and inert gas (which latter term includes nitrogen). By the present invention it is envisaged that the open topped container (which will usually be of metal, plastics, glass or a combination thereof, will be charged with the required volume of beverage through its open top. This open top is then closed to form a sealed package with the internal partition wall and the closure wall to define the primary and secondary chambers with the beverage contained wholly in the primary chamber. In this latter condition it is likely that the headspace in the primary chamber which contains the beverage and also the secondary chamber will contain gas at a pressure greater than atmospheric and be in equilibrium. The sealed beverage package is now inverted and in this condition it will be usual for the closure wall to form a bottom wall on which the package may stand. Following inversion the beverage flows through the restricted orifice from the primary chamber into the secondary chamber until a new condition of equilibrium is attained whereby both chambers contain beverage and each has a headspace in the manner and for the purpose envisaged by the disclosure in our G.B. No. 2,183,592A.

From the aforegoing it will be apparent that the package may simply be formed as a three part structure, that is an open topped container, and the partition and closure walls. Consequently, open topped containers can be charged with their required volume of beverage in a conventional packaging line and thereafter the open top of each container can be sealed by conventional means, for example by seaming the partition and closure walls to an upstanding side wall of the open topped container. Conveniently the sealing of the partition wall occurs simultaneously with the sealing of the closure wall to the container although, if required, the partition wall may be sealed to the side wall of the open topped container prior to the sealing of the closure wall.

Prior to sealing the package and usually subsequent to charging the open topped container with its required volume of beverage, the container will often be purged of air with a selected nitrogen, carbon dioxide or inert gas and the container will be maintained in an atmosphere of such gas until the package is sealed. The environment formed by the selected gas or gases may be at a pressure greater than atmospheric so that such pressure is provided within the package when the container is sealed. Preferably however the pressurisation of the sealed package is achieved by dosing the container with the selected gas in liquid form so that as the gas evaporates it purges the container of air and develops a required gas pressure within the package after sealing. The aforementioned dosing, which usually will be with either liquid nitrogen or liquid carbon dioxide, may be effected to the headspace in the open topped container prior to the location of the partition wall or subsequent to the location of the partition wall (but prior to the location and sealing of the closure wall).

Conveniently the restricted orifice is formed in the partition wall prior to that wall being located over the beverage in the container. The form of the partition wall and the location of the restricted orifice in the wall should be such that following the package being sealed and inverted when there will be formed a headspace in each of the primary and secondary chambers, a substantial headspace will always be maintained in the secondary headspace irrespective of the orientation of the package (and such vibration which the package may reasonably be expected to experience during use). Conveniently the partition wall comprises a dome shaped saucer having its restricted orifice located adjacent to the rim of the saucer (which rim is to be sealed to the open topped container)—with such an arrangement, when the restricted orifice communicates with the primary headspace in the primary chamber, it is likely to communicate with the secondary headspace in the secondary chamber and when the restricted orifice communicates with beverage in the primary chamber it will also communicate with beverage in the secondary chamber while an adequate secondary headspace is maintained for the intended purpose. Alternatively the partition wall may have an undulating or corrugated profile with the restricted orifice located centrally of the container and adjacent to the closure wall so that again a secondary headspace is maintained.

DRAWINGS

One embodiment of a method of packaging a beverage in accordance with the present invention will now be described, by way of example only, with reference to the accompanying illustrative drawings in which:

FIG. 1 is an exploded view of components in a conventional form of three piece can structure;

FIGS. 2 to 6 sequentially and diagrammatically illustrate the use of the components of FIG. 1 for developing a packaged beverage by the method of the present invention, and FIG. 7 diagrammatically illustrates a packaged beverage by the present invention with a modified form of partition wall.

DETAILED DESCRIPTION OF DRAWINGS

Figure 1:
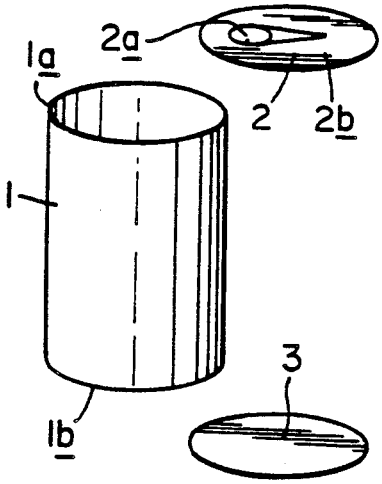

The basic components for a known three piece can structure as shown in FIG. 1 are a cylindrical tube 1 (which is conventionally of thin metal sheeting although it is envisaged that the present invention may be applied to other material such as a plastics tube), a circular flat end wall 2 and a circular flat closure wall 3. Both walls 2 and 3 are of thin metal sheeting and the end wall 2 is openable, conveniently by ripping out a region of that wall with a pull ring 2*a*.

Figure 2:
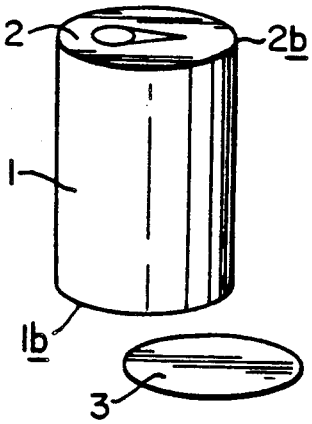
Figure 3:
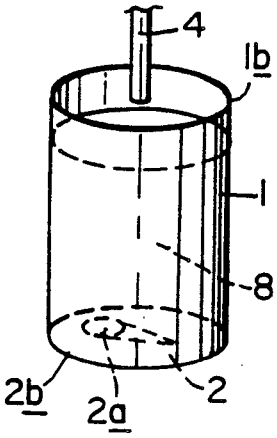

The circumferential edge 2*b* of the end wall is sealed to the circumferential rim 1*a* at an end of the tube 1 (as shown in FIG. 2) by conventional seaming techniques.

The assembly shown in FIG. 2 is now inverted to provide an open topped contained in which the tube forms a cylindrical side wall 1 extending upwardly from a base (formed by the end wall 2) to provide a circumferential rim 1*b*. The open topped container is charged with a required volume of beverage 8 (such as stout) containing mixed carbon dioxide and nitrogen gases in solution as disclosed in our Patent Specification G.B. No. 2,183,592A. The beverage 8 is conveniently fed into the container by way of a filler tube 4 through the open top. The container is not filled, typically a 500 ml capacity container would be charged with approximately 440 ml of beverage.

A domed, saucer shaped, partition wall 5 having a circumferential edge 7 and formed as a pressing in thin sheet metal or as a plastics moulding, is now located over the open top of the container with its concave surface 6 directed upwardly and its edge 7 engaging over the end rim 1*b* of the tubular wall 1. The partition wall 5 is provided with a restricted orifice 9 in its wall. When the partition wall is of plastics (such as food grade polypropylene) the restricted orifice 9 is conveniently formed with an appropriately sized and located pin in the plastics moulding tool. With a sheet metal partition wall the restricted orifice is conveniently formed by stamping during pressing of the partition wall profile. The restricted orifice will usually have a diameter in the order of 0.010 to 0.015 inches (0.25 to 0.38 mms).

Figure 5:
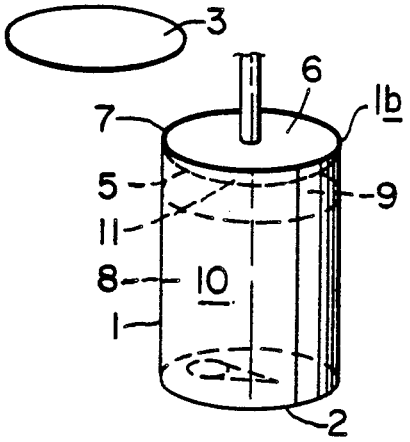

The partition wall 5 is retained in position on the rim 1*b* and sealed thereto by fitting of the closure wall 3 (as shown in FIG. 5) over the open top of the container. This fitting is achieved by seaming the circumferential edge of the sheet metal wall 3 over the circumferential edge 7 of the partition wall 5 and rim 1*b* of the tubular wall 1. The sealed package achieved by seaming of the wall 3 forms both a circumferential seal between the closure wall 3 and the partition wall 5 and between the partition wall 5 and the cylindrical wall 1. Consequently, the beverage 8 is contained within a primary chamber 10 defined between the convex surface of the partition wall 5, the tubular wall 1 and the end wall 2 while a smaller secondary chamber 11 is formed between the concave surface of the partition wall 5 and the flat closure wall 3.

Figure 4:
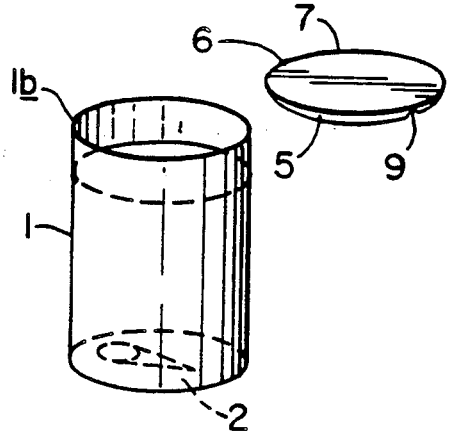

The headspace provided in the sealed package formed as above described with reference to FIG. 5 should be free of air and contain a gas selected from carbon dioxide or nitrogen (or other inert gas) at a pressure greater than atmospheric. To achieve these conditions, prior to fitting the partition wall 5 to the rim 1*b* as described with reference to FIG. 4, the surface of the beverage 8 can be dosed with the selected gas in liquid form (typically liquid nitrogen will be used). As the selected gas evaporates the top part of the container is purged of air during the fitting and sealing of the partition wall 5 and closure wall 3. Following the sealing of the closure wall 3, the continued evaporation of the selected liquid gas develops the desired pressure within the secondary chamber 11 and in the headspace of the primary chamber 10. If required the dosing with the selected liquid gas as aforementioned can be affected following the fitting of the partition wall 5 and with the container assembled to the condition shown in FIG. 5 so that the liquid gas is applied to the concave surface 6 of the partition wall prior to sealing of the closure wall 3. With this latter technique it may be appropriate to provide for gas exchange at the head of the beverage 8 in FIG. 4 to ensure that the container is purged of air prior to fitting the partition wall otherwise adequate time should be provided to permit the liquid gas which is dosed into the partition wall to evaporate and displace air from the container which is located between the partition wall and the surface of the beverage. As an alternative to dosing with a selected gas as aforementioned, the assembly as shown in FIG. 5 can, prior to fitting and sealing the closure wall 3, be subjected to a gas exchange process whereby air within the container is withdrawn and the container is maintained in an environment of the selected gas or gases at a pressure greater than atmospheric until the closure wall 3 is sealed to the container.

Figure 6:
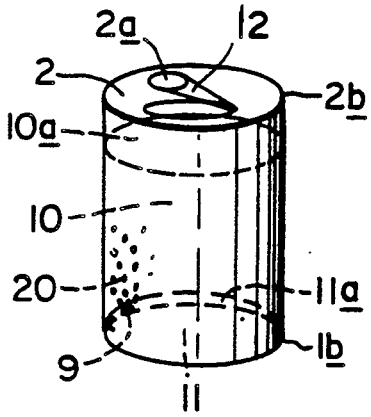

The package formed as described with reference to FIGS. 1 to 5 is now inverted to the condition shown in FIG. 6 whereby the closure wall 3 forms a bottom on which the container can stand and the end wall 2 forms an openable top to the package. Subsequent to inversion of the package, beverage 8 from the primary chamber 10 enters the secondary chamber 11 by way of the restricted orifice 9 until a condition of equilibrium is attained in which the beverage 8 in a primary chamber 10 has a primary headspace 10*a* and the beverage in the secondary chamber 11 has a secondary headspace 11*a*. The restricted orifice 9 is positioned in the partition wall 5 adjacent to the rim 1*b* and to the flat closure wall 3 so that the secondary headspace 11*a*will be maintained irrespective of the orientation of the package or such vibration as the package is likely to experience in practice, for example during transport. Consequently it should not be possible, during normal use, for the secondary chamber 11 to become filled with the beverage.

The beverage package formed as previously described with reference to FIGS. 1 to 5 is typically that which would be made available for storage and retail purposes (often following pasteurisation to which the beverage in the package may be subjected). When it is to be consumed, the beverage within the package is made available and undergoes a similar reaction to that discussed in our Patent Specification G.B. No. 2,183,592A. That is that when the package is opened by ripping out a region 12 in the end wall with the pull ring 2*a*, the primary headspace 10*a* rapidly depressurises to atmospheric pressure. As a consequence the pressure within the secondary headspace 11*a* exceeds that in the primary headspace 10*a* and causes beverage and/or gas in the secondary chamber 11 to be ejected by way of the restricted aperture 9 into the beverage in the primary chamber 10 — this causes gas to be liberated from the beverage (as indicated at 20) to develop or assist in the development of a foam or head on the beverage in the container and when poured therefrom.

Figure 7:
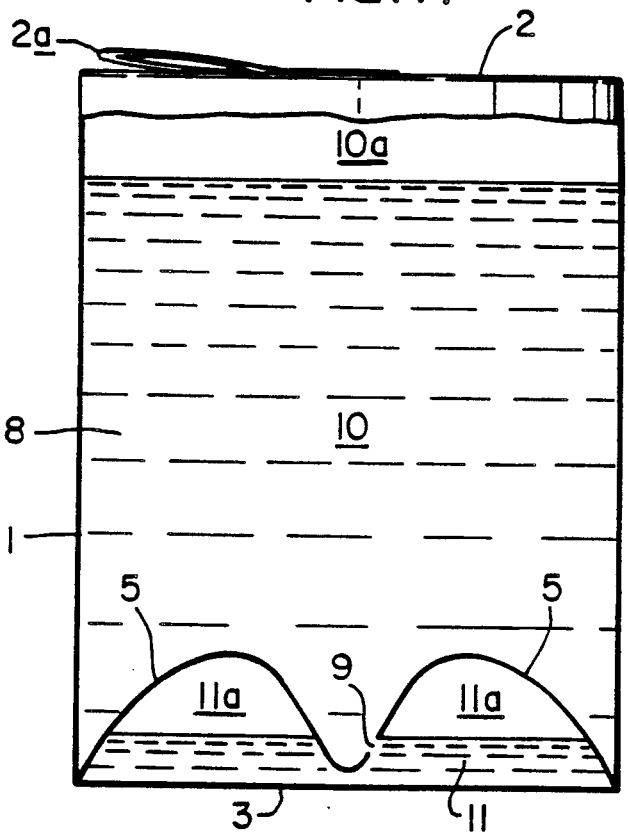

It will be appreciated that the partition wall 5 can be of any shape or profile as required to ensure that a secondary headspace 11*a* will be maintained for the intended purpose irrespective of the orientation of the package. For example, FIG. 7 shows the partition wall 5 with a generally corrugated profile comprising annular and concentric ridges and troughs which are symmetrical about the axis of the tubular container wall 1. The restricted orifice 9 is located in a trough of the corrugations, again to be at a position adjacent to the closure wall 3 but in the embodiment of FIG. 7 the orifice is positioned at or near to the centre of the wall 3 so that, other than for a condition in which the assembly is inverted from the condition shown in FIG. 7, the restricted orifice 9 will communicate between beverage in the primary chamber and beverage in the secondary chamber while maintaining an adequate secondary headspace 11*a*.

In the above described embodiment the beverage package comprises a four piece assembly. If required however the method of packaging can be applied to a three piece assembly in which the end wall 2 is integrally formed with the tubular wall 1, For example as a one piece plastics moulding or sheet metal pressing with appropriate lines of weakness or marking indicating where the package should be pierced or otherwise broached in what is effectively the end wall for the purpose of dispensing the beverage. As a further possibility the wall 1 may be of a typical bottle shape (for example being moulded in plastics) to have a neck with a screw fitted cap or stopper (which serves a similar purpose to the end wall 2 and its region 12) and which stopper or cap is removed from the sealed package for dispensing purposes.

I claim:

1. A method of packaging a beverage having gas in solution therewith which comprises providing an open topped container and charging the container with the beverage; locating a partition wall having a restricted orifice over the beverage in the container to form a primary chamber within which the beverage is contained and which primary chamber is sealed other than for said orifice; locating a closure wall over the partition wall to provide a sealed package in which the closure wall forms with the partition wall a secondary chamber which is sealed other than for the restricted orifice through which the secondary chamber communicates with the primary chamber, and which further comprises subjecting the container over the beverage to a gasifying medium prior to sealing the package so that a gas pressure greater than atmospheric is provided in the sealed package and inverting the sealed package so that the beverage enters the secondary chamber from the primary chamber through said restricted orifice to form a primary headspace in the primary chamber and a secondary headspace in the secondary chamber when the gas and beverage are at equilibrium.

2. A method as claimed in claim 1 which comprises sealing the partition wall and the closure wall substantially simultaneously to the container.

3. A method as claimed in claim 1 which comprises purging the container of air prior to sealing the package with a gas selected from carbon dioxide gas, nitrogen gas and other inert gas.

4. A method as claimed in claim 3 which comprises purging the container of air subsequent to the open topped container being charged with its required volume of beverage.

5. A method as claimed in claim 3 which comprises providing an environment of said selected gas at a pressure greater than atmospheric so that said pressure is provided within the package when the container is sealed.

6. A method as claimed in claim 1 which comprises dosing the container prior to sealing with at least one of liquid carbon dioxide, liquid nitrogen and other inert gas in liquid form and sealing the container so that a required gas pressure develops within the sealed package.

7. A method as claimed in claim 6 in which the dosing is effected to the open topped container subsequent to the container being charged with beverage and prior to the partition wall being located over the beverage.

8. A method as claimed in claim 1 which comprises forming the restricted orifice in the partition wall prior to that wall being located over the beverage in the container.

9. A method as claimed in claim 1 which comprises recessing the partition wall for said wall to present a concave surface to the closure wall.

10. A method as claimed in claim 9 and which comprises providing the partition wall with a profile selected from an undulating profile and corrugated profile to form said concave surface.

11. A method as claimed in claim 1 which comprises forming the closure wall to present a base on which the sealed package can stand following its inversion.

12. A method as claimed in claim 1 which comprises forming the open topped container with an openable part, which part is intended to be opened following inversion of the sealed package to provide communication between the primary headspace and atmosphere for dispensing of the beverage.

13. A method as claimed in claim 12 which comprises forming the openable part as one of a tear-out region and pierceable region of the container.

14. A method as claimed in claim 12 which comprises forming the openable part as one of a removable stopper and a removable cap on the container.

* * * * *